US006008579A

United States Patent [19]

Negi et al.

[11] Patent Number: 6,008,579

[45] Date of Patent: Dec. 28, 1999

[54] ELECTRON TUBE WITH IMPROVED AIRTIGHT SEAL BETWEEN FACEPLATE AND SIDE TUBE

[75] Inventors: Yasuharu Negi; Norio Asakura; Motohiro Suyama; Toshimitsu Nagai, all of Hamamatsu, Japan

[73] Assignee: Hamamatsu Photonics K.K., Shizuoku, Japan

[21] Appl. No.: 09/027,206

[22] Filed: Feb. 20, 1998

[30] Foreign Application Priority Data

Feb. 21, 1997 [JP] Japan ..... 9-038112

[51] Int. Cl.[6] ..... H01J 43/04

[52] U.S. Cl. ..... 313/532; 313/544

[58] Field of Search ..... 313/373, 477 R, 313/527, 530, 542, 532, 544

[56] References Cited

U.S. PATENT DOCUMENTS

| | | |
|---|---|---|
| 3,153,839 | 10/1964 | Pakswer et al. . |
| 4,030,789 | 6/1977 | Schampers et al. . |
| 4,608,517 | 8/1986 | Neuer . |

FOREIGN PATENT DOCUMENTS

| | | |
|---|---|---|
| 0 108 450 | 5/1984 | European Pat. Off. . |
| 2 091 350 | 1/1972 | France . |
| 54-16167 | 2/1979 | Japan . |
| 57-136748 | 8/1982 | Japan . |
| 59-96636 | 6/1984 | Japan . |
| 61-211941 | 9/1986 | Japan . |
| 63-119141 | 5/1988 | Japan . |
| 3-133037 | 6/1991 | Japan . |
| 4-58444 | 2/1992 | Japan . |
| 6-138439 | 11/1994 | Japan . |
| WO 96/17372 | 6/1996 | WIPO . |

*Primary Examiner*—Vip Patel
*Attorney, Agent, or Firm*—Oliff & Berridge, PLC

[57] ABSTRACT

An electron tube in which a side tube and a faceplate are sealed together using a malleable metal with a low melting point. The metal is made to spread out along the outer surface of the faceplate due to pressure from a first sealing portion of a sealing metal support member and along the peripheral surface of the electron tube due to pressure from a second sealing portion of the sealing metal support member. Accordingly, the outer side of the corner portion formed by the faceplate and the side tube is covered with the metal. This construction not only reliably secures the input faceplate to the side tube, but also is extremely effective in preserving the airtightness of the electron tube. Since the first sealing portion is pressed toward the faceplate, an appropriate pressure can be applied to the metal interposed between the first sealing portion and the faceplate, improving the sealability of the metal against the faceplate and the first sealing portion. This construction is also appropriate for mass production of electron tubes.

24 Claims, 10 Drawing Sheets

ELECTRON TUBE WITH IMPROVED AIRTIGHT SEAL BETWEEN FACEPLATE AND SIDE TUBE

BACKGROUND OF THE INVENTION

1. Field of the Invention

The present invention relates to an electron tube in which a side tube and input faceplate are fixedly bonded together by a sealing metal, such as a metal containing predominately indium, which metal is maintained at a temperature below the its melting point, such as room temperature.

2. Description of the Prior Art

One conventional electron tube manufactured according to a cold indium method is described in Japanese Laid-Open Patent Publication (Kokai) No. HEI-4-58444. In this method, the side tube and input faceplate are placed within a vacuum device referred to as a transfer device and connected via indium, which is maintained below its melting point (for example, room temperature) and used in its solid state. When joining the side tube and input faceplate, the input faceplate is pressed against the side tube, deforming the indium. Hence, pressing indium between the side tube and input faceplate achieves a vacuum air-tight seal for the electron tube. Other examples applying to electron tubes manufactured using this cold indium method are described in Japanese Laid-Open Patent Publication (Kokai) Nos. SHO-57-136748, SHO-54-16167 and SHO-61-211941.

Examples of an electron tube manufactured according to a hot indium method are described in Japanese Laid-Open Patent Publication (Kokai) Nos. HEI-6-318439 and HEI-3-133037. In this method, the side tube and input faceplate are joined within the transfer device using indium that has been melted in a heater. An indium collecting depression is provided in the side tube to prevent the melted indium from flowing out of the side tube.

However, various problems occur with electron tubes constructed using the cold indium method described above. For example, this type of electron tube commonly employs a sealing metal support member to cover the outside of the area filled with indium. This support member is a simple ring-shaped member that encircles the side surface of the side tube to hold in the indium. However, since the indium is interposed between the end of the side tube and the inner surface of the input faceplate and the side tube and input faceplate are pressed forcefully into the indium, the sealability between the indium and the surfaces can degrada. Hence, problems with airtightness can occur in these electron tubes, which require sufficiently good airtightness. Due to this poor airtightness, oxygen and moisture from the air can enter the electron tube, degrading the sensitivity of the photocathode. The seal formed with indium is particularly bad when the end of the side tube is formed of a metallic material.

SUMMARY OF THE INVENTION

In view of the foregoing, it is an object of the present invention to provide an electron tube having good airtightness and appropriate for mass production.

To achieve the above and other objects, there is provided an electron tube that includes a side tube, an input faceplate, a photocathode that emits electrons responsive to incident light applied to the photocathode through the input faceplate, a stem, and a sealing member formed with a malleable sealing metal and a support member that encircles the metal. The input faceplate is accommodated and supported by a faceplate accommodating portion formed in the first end portion of the side tube. The stem is provided to the second end portion of the side tube opposite the first end portion. The stem, the side tube, and the input faceplate defines an internal vacuum space of the electron tube. The support member encircling the malleable sealing metal includes a first sealing portion opposing the outer surface of the input faceplate, and a second sealing portion opposing the outer peripheral surface of the side tube. The second sealing portion is substantially orthogonal to the first sealing portion. When assembling the electron tube, the sealing member is pressed again the input faceplate to cause the malleable sealing metal to deform, thereby hermetically sealing the input faceplate and the side tube.

In the electron tube described above, the side tube and input faceplate are joined together with the malleable sealing metal, such as indium or indium alloy. To accomplish this, the input faceplate is placed in the faceplate accommodating portion of the side tube, and the support member is placed over the corner formed by the outer surface of the input faceplate and the outer peripheral surface of the side tube.

At this time, the sealing metal is placed on the inner surface of the sealing metal support member, which is formed of first and second sealing portions. The metal is made to deform and spread out along the outer surface of the input faceplate due to pressure from the first sealing portion and along the outer peripheral surface of the electron tube due to pressure from the second sealing portion.

As a result, the corner formed by the input faceplate and the side tube is covered by the sealing metal. This construction not only reliably secures the input faceplate to the side tube, but also is extremely effective in preserving the airtightness of the electron tube. Since the first sealing portion opposes the input faceplate, the sealing portion can apply pressure toward the input faceplate. Hence, an appropriate pressure can be applied to the metal interposed between the first sealing portion and the input faceplate, thereby improving the sealability of the metal against the faceplate and the first sealing portion and the airtightness of the electron tube. Since the first sealing portion rather than the glass input faceplate is applying pressure to deform the malleable metal, this construction is appropriate for mass production of electron tubes.

Here, it is desirable to form a cutout annular metal accommodating portion in the outer peripheral edge of the input faceplate in order to accommodate sealing metal that is interposed between the first sealing portion and the input faceplate. With this construction, sealing metal can be accommodated in the metal accommodating portion, effectively preventing more metal than necessary from being squeezed out on the outer surface of the input faceplate.

It is also desirable to form a third sealing portion on the inner end of the first sealing portion for extending toward and contacting the outer surface of the input faceplate. With this construction, the space between the first sealing portion and the input faceplate can be filled with sealing metal, while the third sealing portion can prevent more metal than necessary from being squeezed out onto the outer surface of the input faceplate. When the input faceplate is accommodated in the faceplate accommodating potion, the third sealing portion may either be held in contact with the outer surface of the input faceplate or be held separated from the outer surface of the input faceplate.

The faceplate accommodating portion can also be formed with a faceplate support surface opposing and contacting the inner surface of the input faceplate and a side surface opposing the outer peripheral surface of the input faceplate and provided in an upward direction from the faceplate support surface. With this construction, the position of the input faceplate is determined by contact between the outer peripheral surface of the input faceplate and the side surface of the faceplate accommodating portion. Hence, the input faceplate can be reliably centered in relation to the side tube.

The faceplate accommodating portion can also be formed with a faceplate support surface opposing and contacting the inner surface of the input faceplate and a side surface opposing the outer peripheral surface of the input faceplate and provided in an upward direction from the faceplate support surface, such that the annular corner line formed at the intersection of the faceplate support surface and the side surface of the faceplate accommodating portion and the annular corner line formed at the intersection of the inner surface and the peripheral surface of the input faceplate form a close fit with each other. With this construction, not only can the position of the input faceplate be fixed in relation to the side tube, but the side surface of the faceplate accommodating portion and the peripheral surface of the input faceplate can be formed as desired. Accordingly, it is possible to set a desired amount of space between the side surface of the faceplate accommodating portion and the peripheral surface of the input faceplate to control the amount of sealing metal that can enter this space.

According to another aspect of the invention, there is provided a method of assembling a side tube and a faceplate wherein the faceplate is firstly fitted into a faceplate accommodating portion formed at the first end portion of the side tube, and thereafter, the metal support member is pressed toward the faceplate such that the malleable sealing metal is placed over a corner portion formed by the faceplate and the side tube, causing the malleable sealing metal to deform, thereby hermetically sealing the faceplate and the side tube. More specifically, the first sealing portion is held to oppose the faceplate, the second sealing portion to oppose the outer peripheral surface of the side tube, and the first sealing portion is then pressed toward the outer surface of the faceplate. When using a sealing member that further includes a third sealing portion extending in a direction parallel to the first sealing portion, the metal support member is pressed toward the faceplate with the third sealing portion while maintaining the first sealing portion substantially in parallel to the input faceplate. Such an assembling method is applicable not only in the production of electron tubes including photomultiplier tubes but also other kinds of airtight vessels.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

An electron tube according to preferred embodiments of the present invention will be described while referring to the accompanying drawings.

Figure 1:
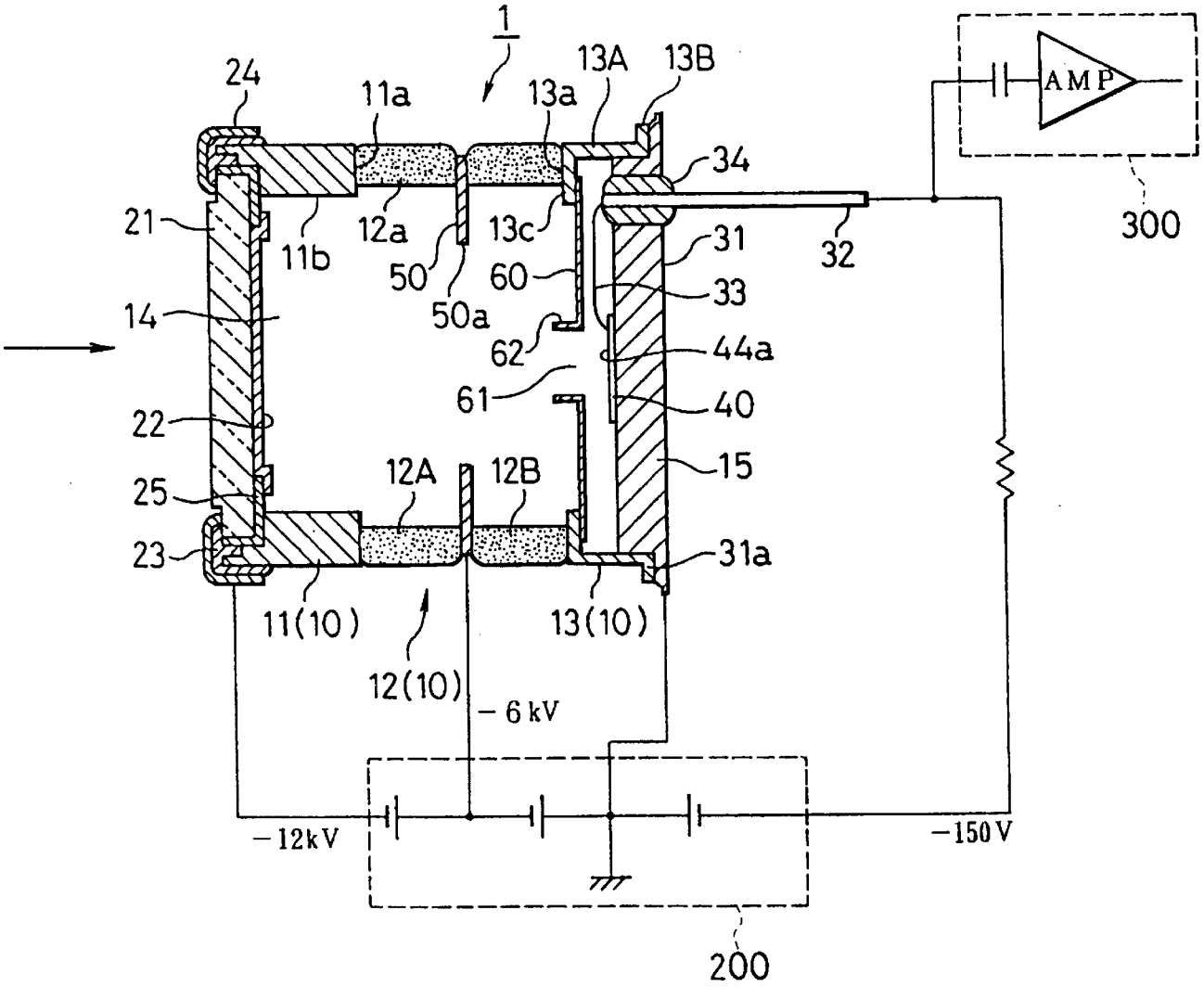
FIG. 1 is a cross-sectional view showing an electron tube according to the first embodiment of the present invention.

FIG. 1 is a cross-sectional view showing an electron tube according to a first embodiment of the present invention. In the drawings, an electron tube 1 is provided with a cylindrical side tube 10. The side tube 10 includes a ring-shaped cathode electrode 11, a ring-shaped bulb 12, a ring-shaped welding electrode 13, and a ring-shaped intermediate electrode 50, all of which parts 11, 12, 13 and 50 are concentric with one another and arranged in layers. The cathode electrode 11 is constructed of the highly conductive Kovar metal using a single-piece molding process such as pressing, injection molding, or machining. The bulb 12 is constructed of an insulating material such as ceramic and formed into two halves, a first bulb 12A and a second bulb 12B. The welding electrode 13 and the intermediate electrode 50 are also constructed of Kovar metal, and the latter is fixed between the first bulb 12A and second bulb 12B.

The bulb 12 containing the intermediate electrode 50 is provided between the cathode electrode 11 and the welding electrode 13. One end of the bulb 12 is pushed against the flat inner surface 11*a* of the cathode electrode 11 and fixed with braze or the like. The other end of the bulb 12 is placed against the flat inner surface 13*a* of the welding electrode 13 and fixed with braze of the like. The bulb 12 is formed by interposing the intermediate electrode 50 between the first bulb 12A and second bulb 12B and brazing the contacting parts. Therefore, the side tube 10 can easily be integrally formed into one piece through brazing.

The cathode electrode 11, bulb 12, and a main cylindrical portion 13A of the welding electrode 13 are all formed with approximately the same external form. In the present embodiment, all these parts have a circular shape with an external diameter of 14 millimeters. This configuration eliminates any unevenness on the external surface of the side tube 10, resulting in a simple shape without protruding parts. As a result, this design improves the universality and ease of handling of the electron tube and is ideal for tight arrangements of multiple electron tubes. An electron tube with such a structure can also withstand high pressure. The external surface of the cathode electrode 11, bulb 12, intermediate electrode 50, and welding electrode 13 can also be shaped as a polygon.

An inner peripheral surface 11*b* of the cathode electrode 11 is positioned further inward than an inner peripheral surface 12*a* of the bulb 12, thereby making the inner diameter of the cathode electrode 11 smaller than the inner diameter of the bulb 12. Therefore, stray electrons happening onto unintended areas of a photocathode 22 described later can be prevented from colliding into the bulb 12, thereby eliminating both charges that occur when these stray electrons collide with the bulb 12 and the effects caused by these charges on the electron orbit. The cathode electrode 11 serves also as the focus electrode of the electron tube 1. Therefore, when a specified voltage is applied to the electron tube 1, the electrons emitted from the photocathode 22 within the effective diameter of 8 millimeters must be converged to a diameter of about 2 millimeters onto a semiconductor device 40. It is desirable, therefore, for the cathode electrode 11 to have an inner diameter of 10 millimeters and a length of 3 millimeters, and for the ceramic bulbs 12A and 12B to have an inner diameter of 11 millimeters and a length of 3 millimeters.

The intermediate electrode 50 described above protrudes inward from the inner surface 12*a* of the bulb 12. The inner diameter of an opening 50*a* in the intermediate electrode 50 is as small as possible without interfering with the electron orbit. An appropriate inner diameter, therefore, is about 7 millimeters. Hence, charges of the bulb 12 caused by stray electrons can be prevented. Even if the bulb 12 is charged for any reason, the charge will be prevented from harmfully affecting the electron orbit, because the intermediate electrode 50 fixes the potential to an area near the electron orbit. The thickness of the intermediate electrode 50 should be about 0.5 millimeters.

A disc-shaped stem 31 formed of an electrically conductive material such as Kovar metal is fixed to the welding electrode 13 in a second opening 15 of the side tube 10. A circular first flange portion 13B is formed on the outer end of the main cylindrical portion 13A protruding outward and is used to join with the stem 31. A circular second flange portion 13C is formed on the inner end of the main cylindrical portion 13A protruding inward and is used to join with the bulb 12. A circular cutout edge portion 31*a* is formed on the outer periphery of the stem 31 for fitting over the first flange portion 13B. Hence, the first flange portion 13B of the welding electrode 13 is fitted over the cutout edge portion 31*a* of the stem 31, enabling the welding electrode 13 and stem 31 to easily be joined through simple assembly work that only requires resistance welding. The side tube 10 fits extremely well with the stem 31 during resistance welding. A penetrating pin 32 is fixed in the stem 31. A glass 34 insulates the penetrating pin 32.

A semiconductor device 40 is fixed via a conductive adhesive to the vacuum side surface of the stem 31 and operates as an APD (Avalanche Photodiode). The semiconductor device 40 includes an electron incidence surface 44*a* having a diameter of approximately 3 millimeters. A prescribed section of the semiconductor device 40 is connected to the penetrating pin 32 via a wire 33. Further, a plate-shaped anode 60 is positioned between the semiconductor device 40 and the intermediate electrode 50 and nearer to the semiconductor device 40, whereby the peripheral edge of the anode 60 is fixed on the second flange portion 13C of the welding electrode 13. This anode 60 is a thin plate of stainless steel with a thickness of 0.3 millimeters and is formed by pressing. The gap between the anode 60 and the semiconductor device 40 should be 1 millimeter.

An opening 61 is formed in the center of the anode 60 opposite the electron incidence surface 44*a* of the semiconductor device 40. A cylindrical collimator portion (collimator electrode) 62 is integrally formed on the anode 60 and protrudes toward the photocathode 22, concentric with and encircling the opening 61. The collimator portion 62 should have an inner diameter of 3.0 millimeters and a height of 1.3 millimeters. It is possible for the anode 60 to be preformed on the extended end of the second flange portion 13C, so that the welding electrode 13 serves as the anode 60.

Figure 2:
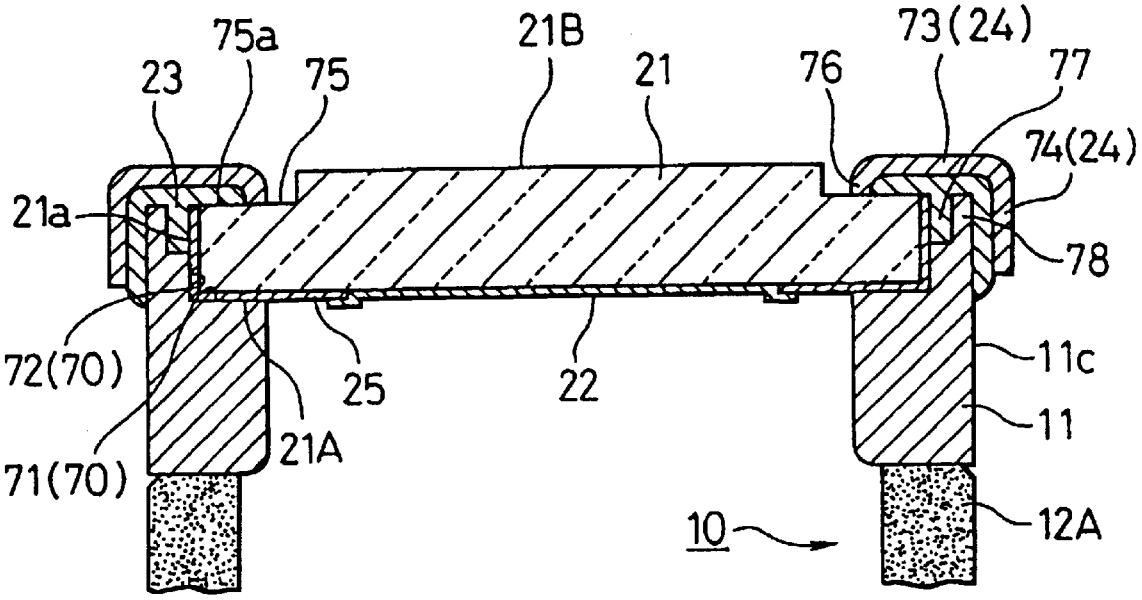
FIG. 2 is an expanded cross-sectional view showing the relevant parts of the electron tube in FIG. 1.

As shown in FIGS. 1 and 2, the input faceplate 21 composed of light-permeable glass is fixed to the cathode electrode 11 and positioned on the first opening 14 side of the side tube 10. The photocathode 22 is provided on the inner side of the input faceplate 21. After the photocathode 22 is manufactured, the input faceplate 21 is integrated with the cathode electrode 11 via a malleable metal 23. For example, indium, a predominantly indium alloy, lead, a lead alloy, or gold (Au) can be used as the sealing metal. Such sealing metals have a low melting point. The metal 23 serves as a sealing metal, forming a seal between the input faceplate 21 and the end face of the side tube 10. In addition, an annular sealing metal support member 24 formed of Kovar metal encircles the area sealed by the metal 23.

A photocathode electrode 25 formed of a thin chrome film is placed in the area surrounding the photocathode 22 so as to form an electrical connection between the photocathode 22 and the metal support member 24 via metal 23 and the cathode electrode 11. The photocathode electrode 25 may be formed of a thin nickel or copper film. The photocathode electrode 25 is formed by evaporation and extends to the outer peripheral surface 21*a* of the input faceplate 21 so that the photocathode 25 is in physical contact with the metal 23. In this manner, the extended photocathode electrode 25 ensures an electrical connection between the photocathode electrode 25 and the metal 23. The photocathode electrode 25 has an inner diameter of 8 millimeters for regulating the effective diameter of the photocathode 22. The photocathode electrode 25 may only be in contact with a faceplate supporting surface 71 forming a faceplate accommodating portion 70 to be described later on so as to preserve an electrical connection between the photocathode electrode 25 and the metal 23.

A power source 200 applies negative voltages, for example, −12 kilovolts to the cathode electrode 11, and −6 kilovolts to the intermediate electrode 50. Also, −150 volts is applied via a resistor to both the semiconductor device 40 and a processing circuit 300.

As shown in FIG. 2, the faceplate accommodating portion 70 is formed as an annular cutout portion in the inner end of the cathode electrode 11. The faceplate accommodating portion 70 is formed with a faceplate supporting surface 71 for contacting the inner surface 21A of the input faceplate 21 and supporting the input faceplate 21; and a side surface 72 formed orthogonal to the faceplate supporting surface 71. Both surfaces 71 and 72 serve to house the input faceplate 21. By forming the side surface 72 in contact with the outer peripheral surface 21*a* of the input faceplate 21, it is possible to reliably center and fix the position of the input faceplate 21 in relation to the side tube 10. However, the side surface 72 may not be in contact with the outer peripheral surface 21*a* of the input faceplate 21 in the final product.

The metal support member 24 includes first and second sealing portions 73 and 74 for protecting the corner portion formed by the input faceplate 21 and the side tube 10. The first sealing portion 73 is annular shaped and opposes the outer surface 21B of the input faceplate 21. The second sealing portion 74 is annular shaped and opposes the peripheral surface 11*c* of the cathode electrode 11, approximately orthogonal to the first sealing portion 73.

The space between the metal support member 24 and the input faceplate 21 and side tube 10 is filled with metal 23 having a low melting point. The metal 23 extends along the inner surface of the metal support member 24 from the outer surface 21B of the input faceplate 21 to the peripheral surface 11*c* of the cathode electrode 11. In other words, the metal 23 is made to spread out along the outer surface 21B due to the first sealing portion 73 and along the peripheral surface 11*c* due to the second sealing portion 73. Accordingly, it is possible to completely cover the outer side of the corner portion formed by the input faceplate 21 and the side tube 10 with the metal 23. This construction not only reliably secures the input faceplate 21 to the side tube 10, but also is extremely effective in preserving the airtightness of the electron tube 1.

An annular metal accommodating portion 75 is formed by cutting out the peripheral edge of the outer surface 21B. The metal accommodating portion 75 includes a step surface 75*a* parallel to but a step lower than the outer surface 21B of the input faceplate 21. A third sealing portion 76 in the form of an annular shape is integrally formed on the inner end of the first sealing portion 73 and extends down to meet the step surface 75*a*. This third sealing portion 76 forces metal 23 to be sealed in the gap between the inner surface of the first sealing portion 73 and the step surface 75*a*. Hence, the third sealing portion 76 can sufficiently prevent more metal 23 than necessary from being squeezed out onto the outer surface 21*b* of the input faceplate 21 and contaminating the light incident area of the input faceplate 21. Even if some of the metal 23 squeezes past the third sealing portion 76 and escapes from the metal support member 24, the metal 23 will still be contained within the metal accommodating portion 75. Hence, more metal 23 than necessary can be reliably prevented from squeezing out onto the outer surface 21B.

In order to improve the adhesion and airtightness between the input faceplate 21 and the side tube 10, it is necessary to interpose a prescribed amount of metal 23 between the outer peripheral surface 21*a* of the input faceplate 21 and the end of the side tube 10. For this reason, a cutout metal inflow portion 77 is formed in the end of the cathode electrode 11. This metal inflow portion 77 is created by a protruding portion 78 formed in a position separated from the outer peripheral surface 21*a* of the input faceplate 21, providing an opening for metal 23 to flow in. The metal inflow portion 77, located between the cathode electrode 11 and the input faceplate 21, is groove-shaped with a width of 0.3 millimeters. The metal inflow portion 77 is opened at the end facing the first sealing portion 73, allowing metal 23 within the first sealing portion 73 to flow into the metal inflow portion 77.

The surface of the first sealing portion 73 may either be in flush with the outer surface of the input faceplate 21 or be held in a level lower than the outer surface of the input faceplate 21. In the latter case, it is desirable when some optical components, such as scintillators, are aligned on the input faceplate, because the contact of the optical components with the metal support member 24 can be avoided.

Next, the procedure for sealing the metal 23 between the side tube 10 and input faceplate 21 within a vacuum device (not shown; also referred to as a transfer device) will be briefly described with reference to FIG. 3. During this sealing process, the transfer device is maintained at a temperature below the melting point of the metal 23, such as room temperature.

Figure 3:
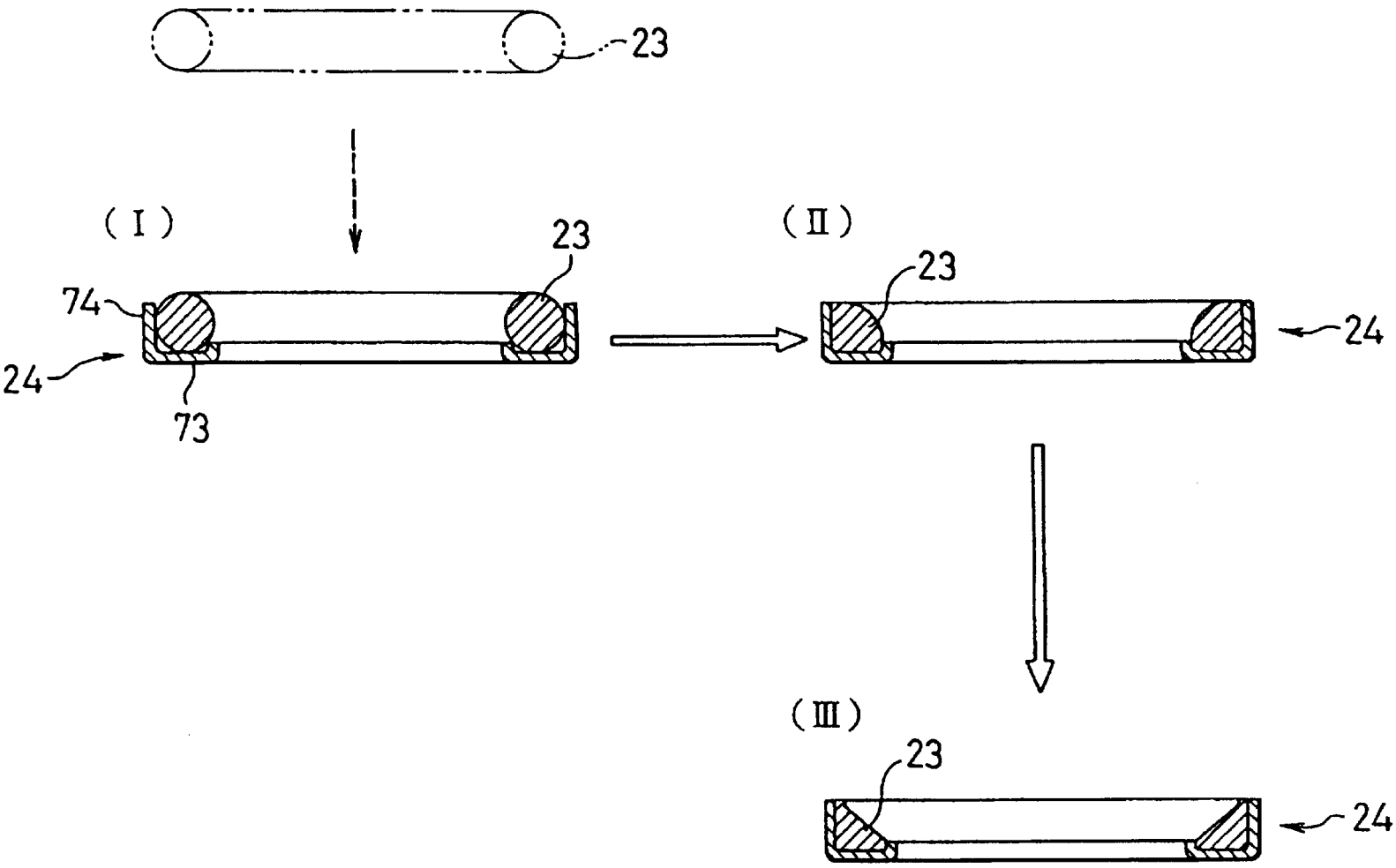
FIG. 3 is a cross-sectional view showing a process of forming a low melting metal on a sealing metal support member.

As shown in step (I) of FIG. 3, a ring-shaped metal 23 of a prescribed amount is placed on the metal support member 24 such that the metal 23 contacts the inner sides of the first and second sealing portions 73 and 74 of the metal support member 24. In step (II), the metal 23 is heated at 500° C. and melted in order to form the metal 23 integrally with the metal support member 24. After the metal 23 has cooled, excess metal 23 is cut off using a cutter or similar instrument, to form the shape shown in step (III). The integrated metal 23 and metal support member 24 are inserted into the transfer device.

Figure 4:
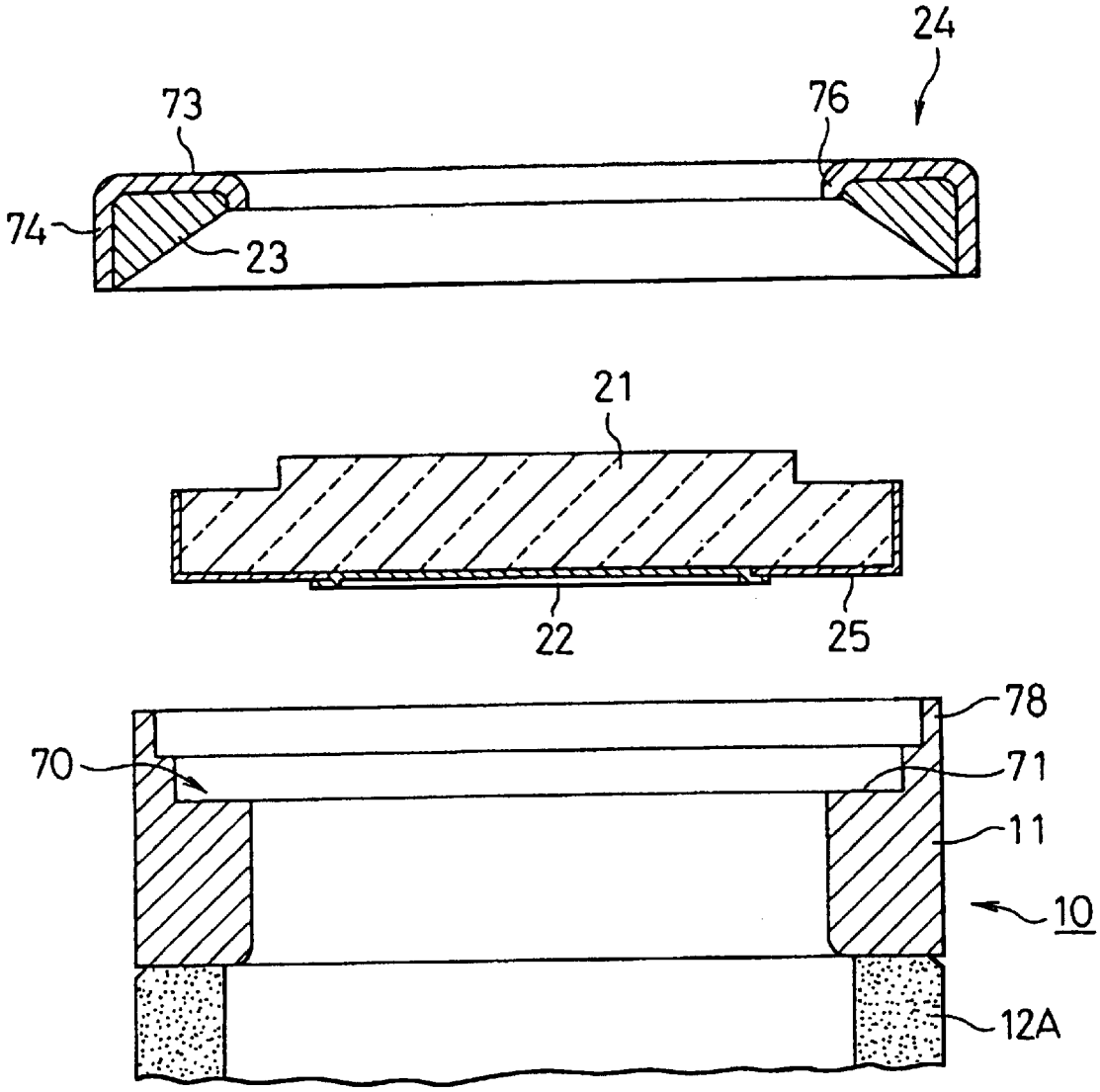
FIG. 4 is an expanded cross-sectional view showing the relevant parts used in assembling the electron tube of FIG. 1.

FIG. 4 illustrates how the preassembled side tube 10, the input faceplate 21 with photoelectric surface 22, and the metal support member 24 with metal 23 are assembled together in the transfer device. First, the input faceplate 21 is fitted into the faceplate accommodating portion 70 in the cathode electrode 11. The metal support member 24 is pressed down on the input faceplate 21 such that the metal 23 is placed over the corner portion formed by the input faceplate 21 and the side tube 10, causing the metal 23 to deform. Since the first sealing portion 73 is being pressed toward the input faceplate 21, an appropriate pressure is applied to the metal 23 interposed between the first sealing portion 73 and the input faceplate 21. As a result of this pressure, an appropriate pressure is also applied to the metal 23 interposed between the second sealing portion 74 and the cathode electrode 11. Accordingly, the sealability of the metal 23 against the input faceplate 21 and the cathode electrode 11 is improved, increasing the airtightness of the electron tube 1.

Since the third sealing portion 76 presses directly against the input faceplate 21, the inner surface 21A of the input faceplate 21 can be held against the faceplate supporting surface 71, maintaining airtightness at this juncture. The above method of using pressure from the first sealing portion 73 to deform the metal 23, is more suitable for the mass production of electron tubes 1 than the method of applying direct pressure to the glass input faceplate 21 via jigs, or the like.

Figure 5:
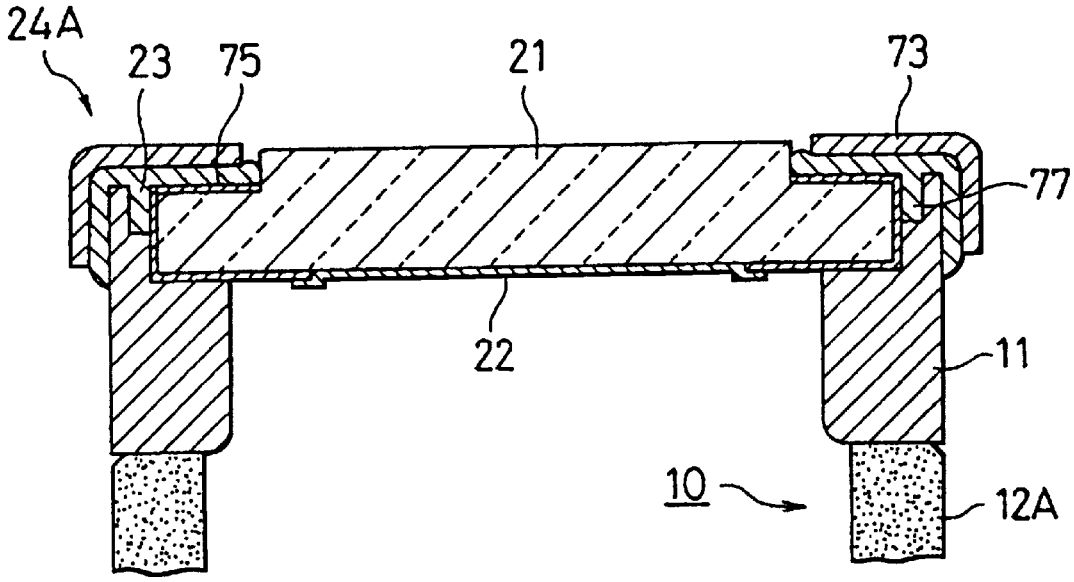
FIG. 5 is an expanded cross-sectional view showing an electron tube according to the second embodiment of the present invention.

A second embodiment of the present invention is shown in FIG. 5. As shown therein, the metal support member 24 is formed without the third sealing portion 76. With this configuration, the excess metal 23 squeezed out by the first sealing portion 73 will be contained by the metal accommodating portion 75. Accordingly, more metal 23 than necessary can be prevented from being squeezed out onto the outer surface 21B of the input faceplate 21 and from contaminating the light incident area of the input faceplate 21.

Figure 6:
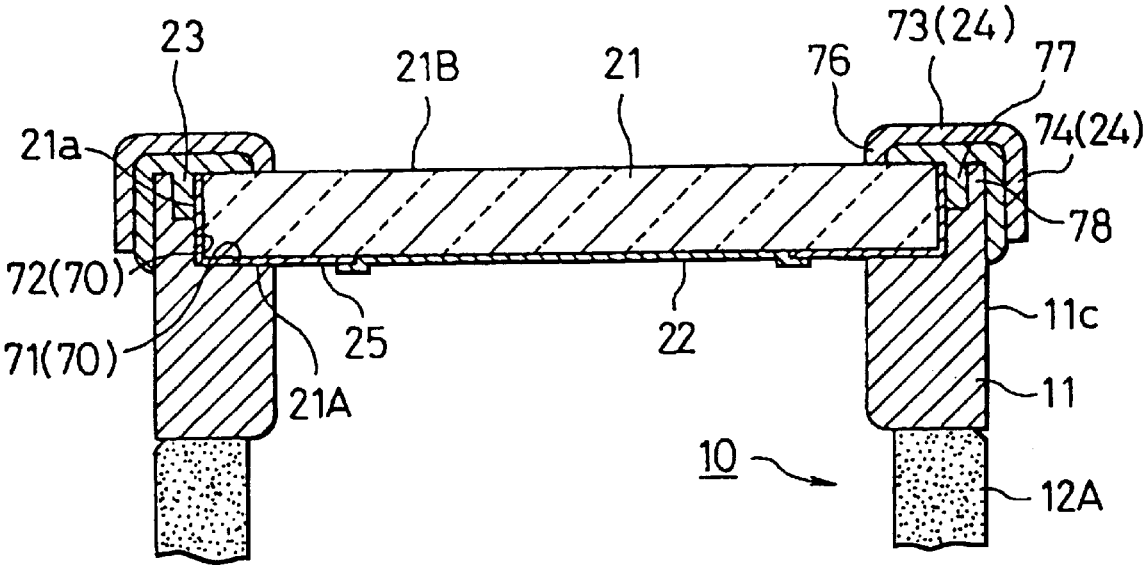
FIG. 6 is an expanded cross-sectional view showing an electron tube according to the third embodiment of the present invention.

A third embodiment of the present invention is shown in FIG. 6. In the third embodiment, the metal accommodating portion 75 is not formed in the input faceplate 21. In this case, the third sealing portion 76 contacts directly with the outer surface 21B of the input faceplate 21, preventing more metal 23 than necessary from being squeezed out onto the outer surface 21B.

Figure 7:
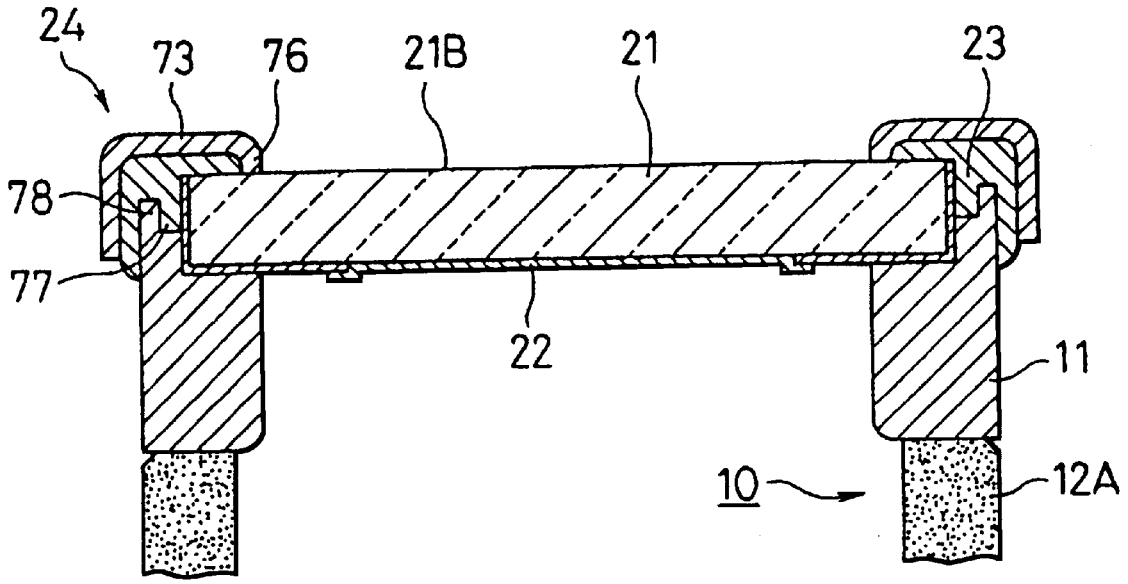
FIG. 7 is an expanded cross-sectional view showing an electron tube according to the fourth embodiment of the present invention.

A fourth embodiment of the present invention is shown in FIG. 7. The embodiment of FIG. 7 is identical to the third embodiment of FIG. 6, except the protruding portion 78 has been made shorter. Although this decreases the volume of the metal inflow portion 77, a larger amount of metal 23 can be contained within the metal support member 24.

Figure 8:
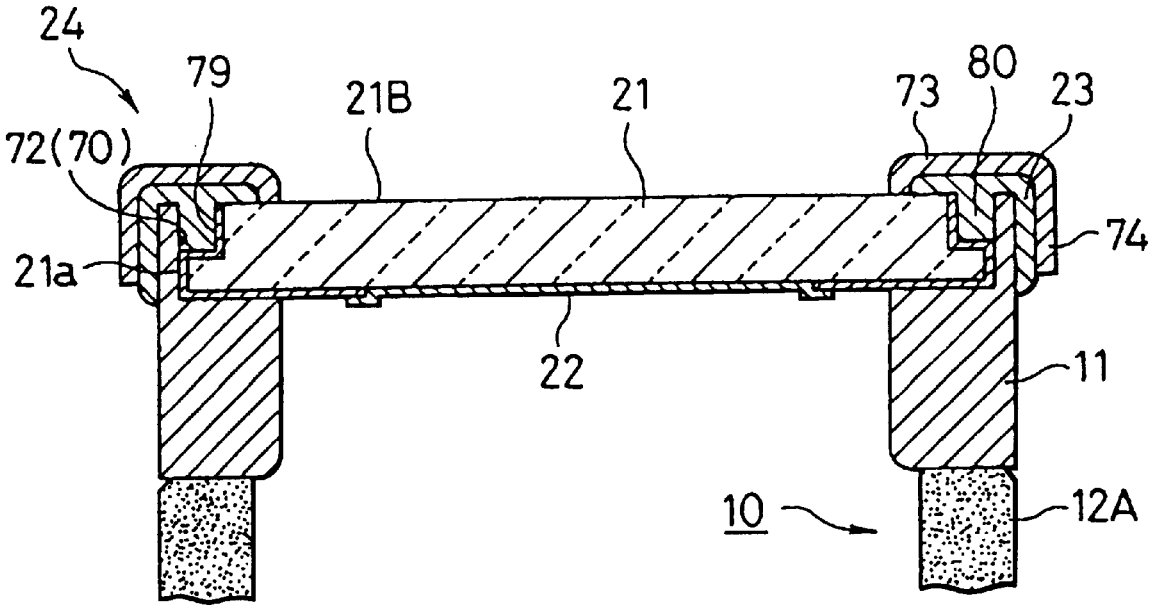
FIG. 8 is an expanded cross-sectional view showing an electron tube according to the fifth embodiment of the present invention.

A fifth embodiment of the present invention is shown in FIG. 8. In the embodiment of FIG. 8, an L-shaped cutout surface 79 is formed in the outer edge of the outer surface 21B. Further, the side surface 72 of the faceplate accommodating portion 70 rises to a height level with the outer surface 21B. Accordingly, the cutout surface 79 and the side surface 72 together form a metal inflow portion 80 having a rectangular cross-section.

Figure 9:
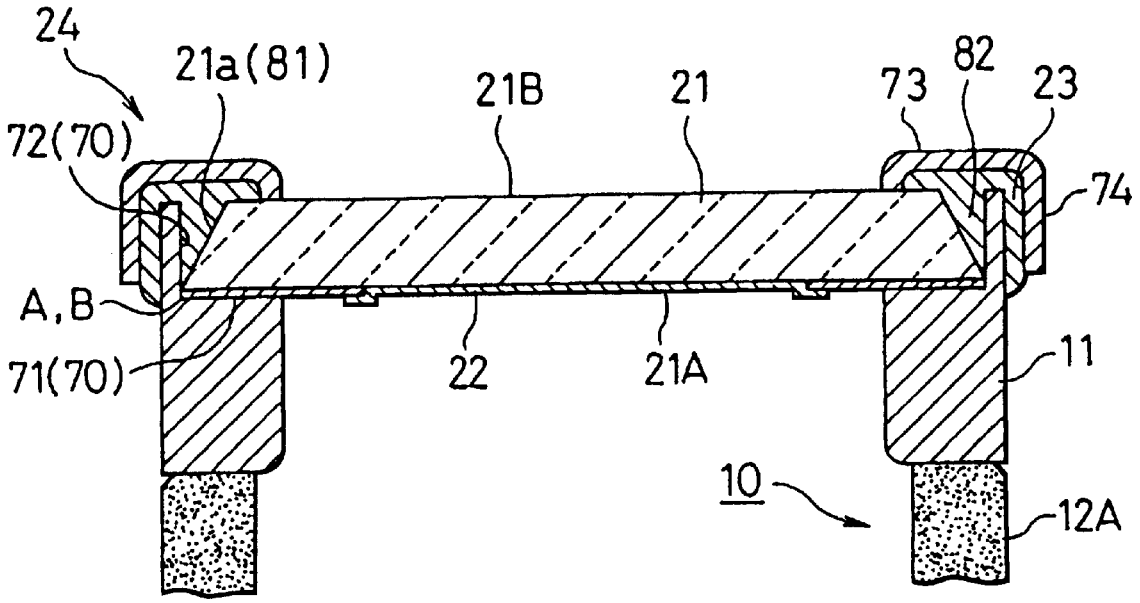
FIG. 9 is an expanded cross-sectional view showing an electron tube according to the sixth embodiment of the present invention.

A sixth embodiment of the present invention is shown in FIG. 9. In the embodiment of FIG. 9, instead of the L-shaped cutout surface 79, a tapered cutout surface 81 is formed in the outer edge of the outer surface 21B and tapers outward from the outer surface 21B to the bottom corner of the input faceplate 21. As in the fifth embodiment of FIG. 8, the side surface 72 of the faceplate accommodating portion 70 rises to a height level with the outer surface 21B. Accordingly, the cutout surface 81 and the side surface 72 together form a metal inflow portion 82 having a triangular cross-section.

An annular corner line A is formed at the intersection of the faceplate supporting surface 71 and the side surface 72. Another annular corner line B is formed at the intersection of the inner surface 21A of the input faceplate 21 and the cutout surface 81 (outer peripheral surface 21*a*). Accordingly, it is possible to fix the position of the input faceplate 21 in relation to the side tube 10 by fitting the corner line B into the corner line A. With this method for establishing the position of the input faceplate 21, the side surface 72 and the outer peripheral surface 21*a* can be formed in desired shapes, thereby creating the metal inflow portion 82 in a desired shape to allow a required amount of metal 23 to enter the metal inflow portion 82.

Figure 10:
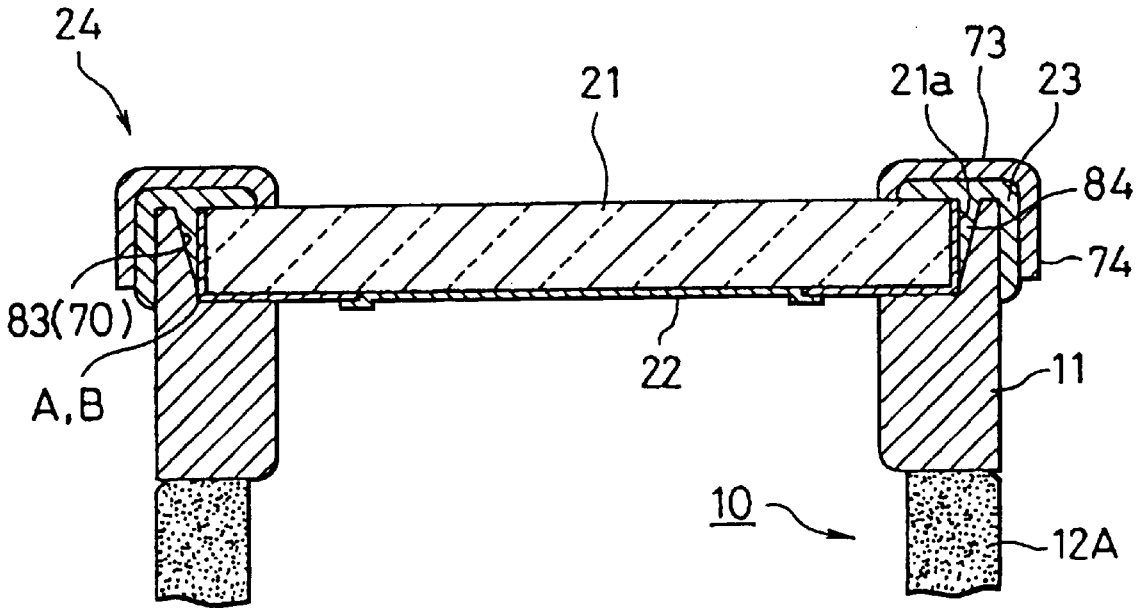
FIG. 10 is an expanded cross-sectional view showing an electron tube according to the seventh embodiment of the present invention.

A seventh embodiment of the present invention is shown in FIG. 10. In the embodiment of FIG. 10, the shape of the input faceplate 21 is similar to that in FIG. 6. However, a tapered cutout surface 83 is formed in the faceplate accommodating portion 70 and tapers from the top of the cathode electrode 11 inward to the bottom corner of the input faceplate 21. Since the outer peripheral surface 21*a* is orthogonal to the outer surface 21B, a metal inflow portion 84 formed by the cutout surface 83 and the outer peripheral surface 21*a* has a triangular cross-section. As in the embodiment of FIG. 9, the corner line A of the faceplate accommodating portion 70 and the corner line B of the input faceplate 21 serve to fix the position of the input faceplate 21 in relation to the side tube 10.

Figure 11:
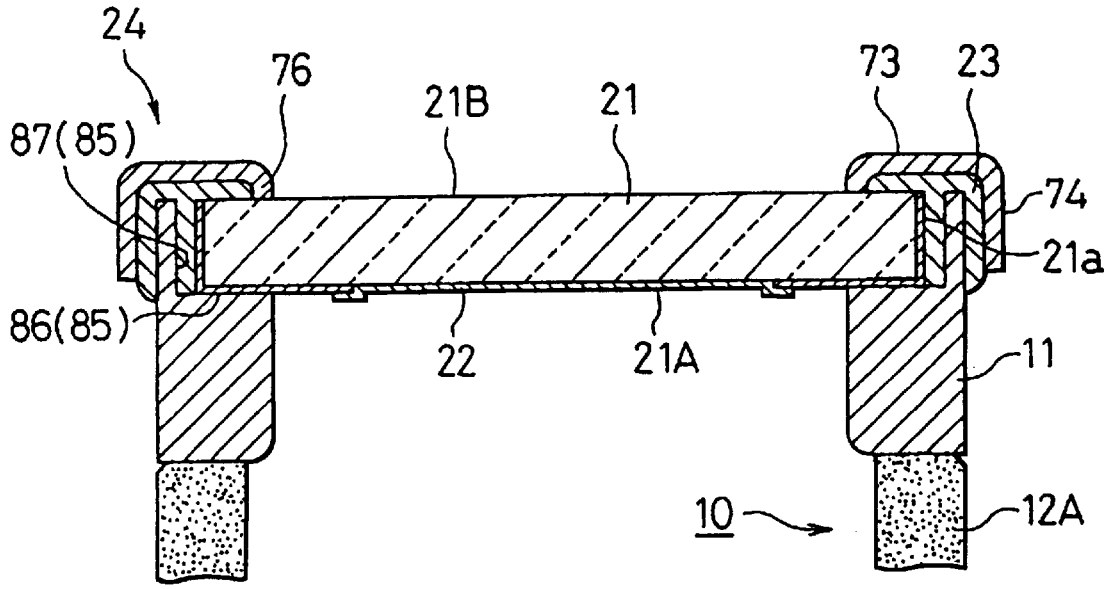
FIG. 11 is an expanded cross-sectional view showing an electron tube according to the eighth embodiment of the present invention.

An eighth embodiment of the present invention is shown in FIG. 11. In the embodiment of FIG. 11, a faceplate accommodating portion 85 having no function for accurately fixing the position of the input faceplate 21 in relation to the side tube 10 is formed in the cathode electrode 11. The faceplate accommodating portion 85 is formed with a faceplate supporting surface 86 for contacting the inner surface 21A of the input faceplate 21 and supporting the input faceplate 21; and a side surface 87 formed orthogonal to the faceplate supporting surface 86. Both surfaces 86 and 87 serve to house the input faceplate 21. The diameter of the side surface 87 is larger than that of the peripheral surface 21*a*, allowing the input faceplate 21 to be loose within the faceplate accommodating portion 85. This construction is most suitable for mass production or for lowering costs when extreme precision is not required for centering the input faceplate 21 in relation to the side tube 10.

Figure 12:
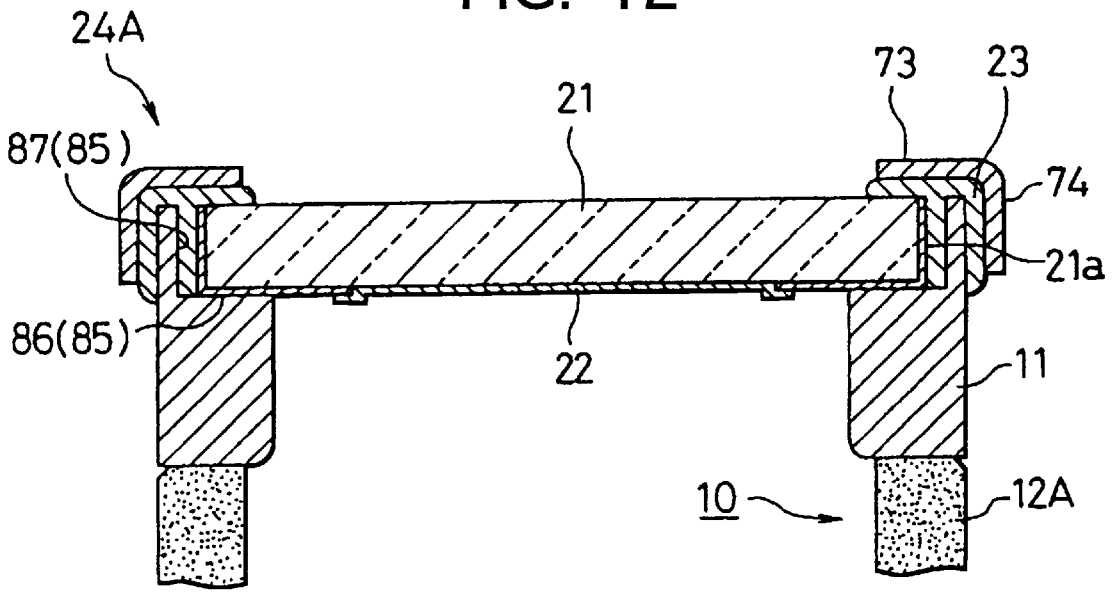
FIG. 12 is an expanded cross-sectional view showing an electron tube according to the ninth embodiment of the present invention.

A ninth embodiment of the present invention is shown in FIG. 12. The embodiment of FIG. 12 is similar to that in FIG. 11 above, except a metal support member 24A having no third sealing portion 76 is used in place of the metal support member 24.

Figure 13:
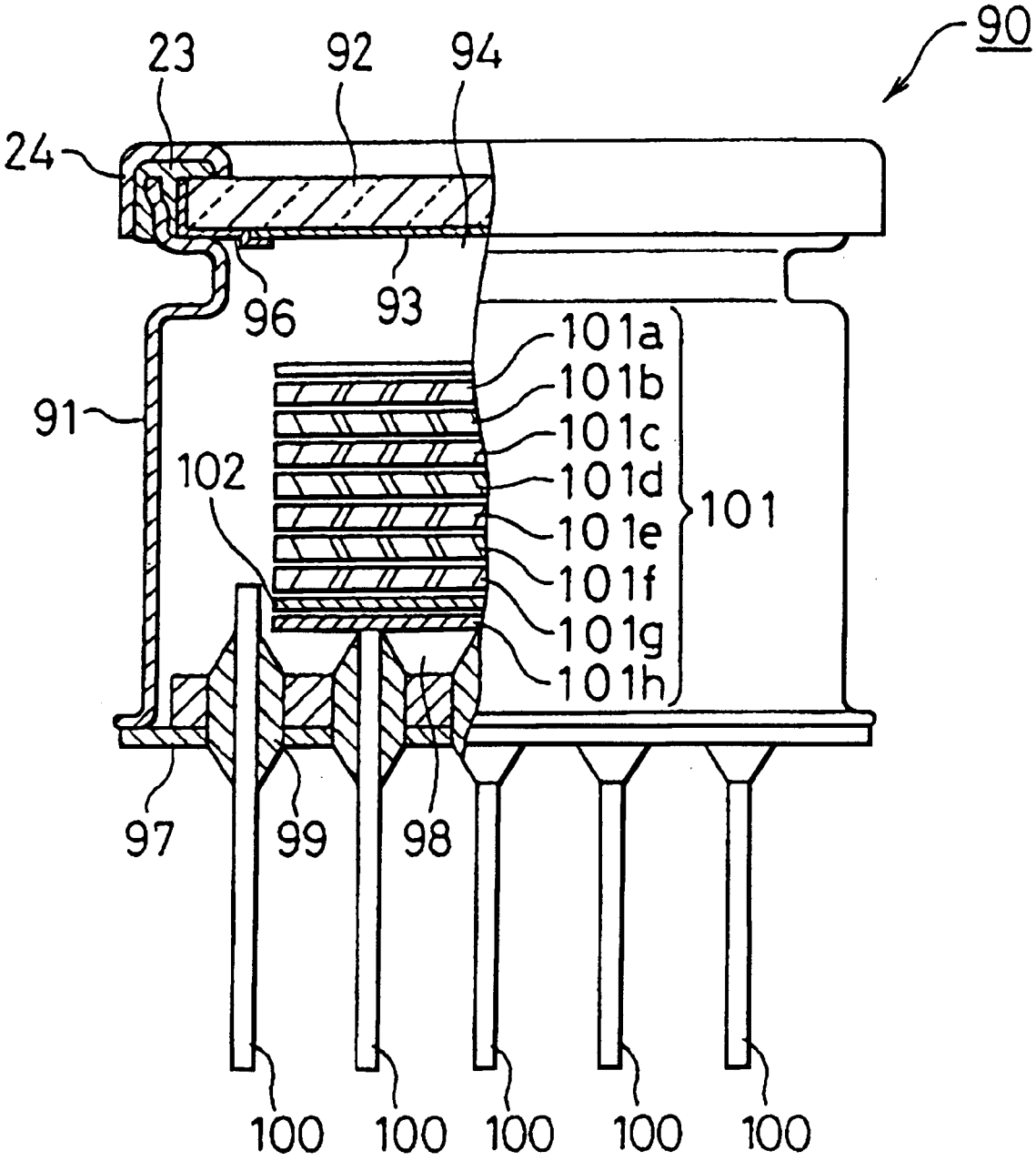
FIG. 13 is an expanded cross-sectional view showing an electron tube according to the tenth embodiment of the present invention.

A photomultiplier tube 90 shown in FIG. 13 has a TO-8 package size. This photomultiplier tube 90 is provided with a cylindrical side tube 91 that is pressed from Kovar metal to a thickness of 0.3 millimeters and an overall length of 10 millimeters. An input faceplate 92 manufactured from light-permeable glass is fixed on one end of the side tube 91. A GaAs photocathode 93 is provided on the inside of the input faceplate 92. A first opening 94 is provided in the side tube 91.

After the photocathode 93 is made active with cesium vapor and oxygen, the input faceplate 92 is integrated with the side tube 91 via a malleable metal 23 (for example, indium, a predominantly indium alloy, lead, a lead alloy or gold) having a low melting point. The metal 23 serves as a sealing metal, forming a seal between the input faceplate 92 and the end face of the side tube 91. In addition, an annular sealing metal support member 24 formed of Kovar metal encircles the area sealed by the metal 23. A photocathode electrode 96 formed of a thin chrome film is placed in the surrounding area of the photocathode 93 so as to form an electrical connection between the photocathode 93 and the metal 23. The inner diameter of the photocathode electrode 96 regulates the effective diameter of the photocathode 93.

A disc-shaped stem 97 formed of an electrically conductive material such as Kovar metal is fixed to the other end of the side tube 91 by resistance welding. The stem 97 is provided in a second opening 98 of the side tube 91. A plurality of penetrating pins 100 penetrate the stem 31. The penetrating pins 100 are insulated by glass 99. A dynode stack 101 is provided in the side tube 91 for multiplying electrons emitted from the photocathode 93. The dynode stack 101 is constructed from 8 levels of dynode units 101*a*–101*h*, which are resistance welded together. The dynode stack 101 is fixed within the side tube 91 by resistance welding each of the dynode units 101*a*–101*h* to each of the penetrating pins 100. An anode 102 is provided above the last dynode unit 101*h* for detecting and converging the multiplied electrons.

Figure 14:
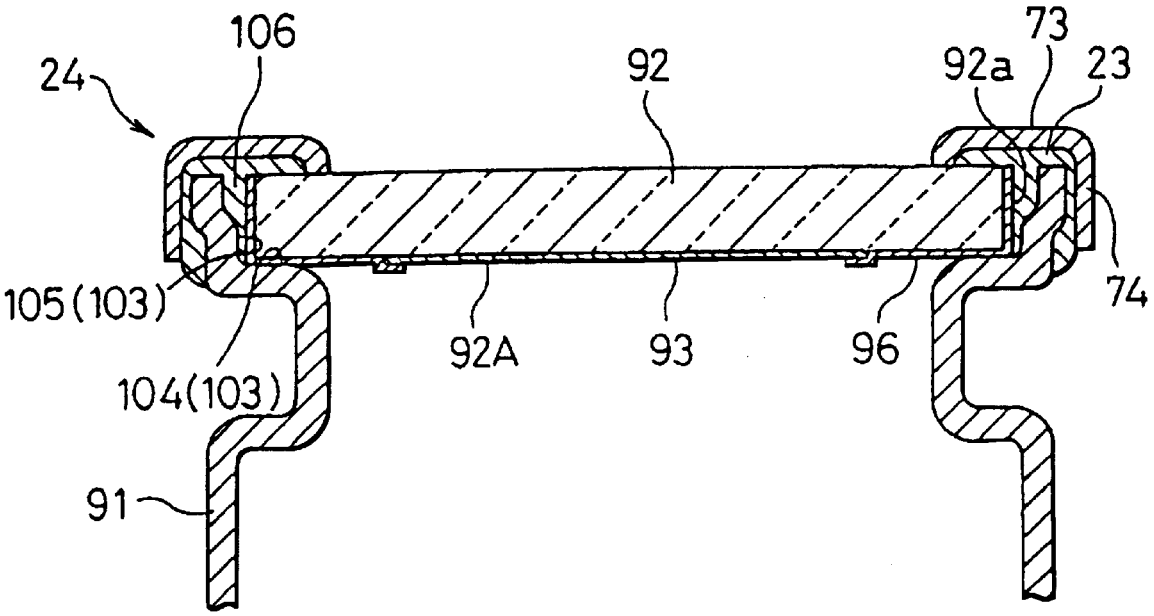
FIG. 14 is an expanded cross-sectional view showing the relevant parts of the electron tube in FIG. 13.

FIG. 14 is an expanded cross-sectional view showing the relevant parts of the electron tube shown in FIG. 13. As shown in FIG. 14, the end of the side tube 91 is pressed to form a faceplate accommodating portion 103. The faceplate accommodating portion 103 is formed with a faceplate supporting surface 104 for contacting the inner surface 92A of the input faceplate 92 and supporting the input faceplate 92; and a side surface 105 formed approximately orthogonal to the faceplate supporting surface 104. Both surfaces 104 and 105 serve to house the input faceplate 92. Since the very end of the electron tube 91 is bent outward in the peripheral direction, the side surface 105 of the faceplate accommodating portion 103 is separated from the peripheral surface 92*a* of the input faceplate 92, forming a metal inflow portion 106 in the area of separation. Hence, by simply bending the end of the electron tube 91 into the shape described above, it is possible to form a desirable faceplate accommodating portion 103 and metal inflow portion 106, which not only can simplify design variations, but can be applied to a wide-variety of products.

An electron tube according to the present invention having the construction described above has the following effects. An annular faceplate accommodating portion is formed in the end surface of the side tube for accommodating and supporting the input faceplate. A sealing metal support member includes a first annular sealing portion opposing the outer surface of the input faceplate, and a second annular sealing portion opposing the peripheral surface of the electron tube, approximately orthogonal to the first sealing portion. This construction provides good airtightness for the electron tube and, because it is possible to deform the sealing metal by applying pressure to the first sealing portion, is suitable for mass production.

Although the present invention has been described with respect to specific embodiments, it will be appreciated by one skilled in the art that a variety of changes may be made without departing from the scope of the invention. For example, certain features may be used independently of others and equivalents may be substituted all within the spirit and scope of the invention.

What is claimed is:

1. An electron tube having an internal vacuum space, comprising:

a side tube having an imaginary central axis, an inner peripheral surface, an outer peripheral surface, a first end portion at one end in a direction of the imaginary central axis, and a second end portion opposite the first end portion, the first end portion having an end face;

an input faceplate accommodated and supported by a faceplate accommodating portion formed in the first end portion of said side tube, said input faceplate having an inner surface, an outer surface, and an outer peripheral surface;

a photocathode that emits electrons responsive to incident light applied to said photocathode through said input faceplate;

a stem provided to the second end portion of said side tube, said stem, said side tube, and said input faceplate defining the internal vacuum space; and a sealing member formed with a malleable sealing metal and a support member that encircles said malleable sealing metal, said support member including a first sealing portion opposing the outer surface of said input faceplate, and a second sealing portion opposing the outer peripheral surface of said side tube, said second sealing portion being substantially orthogonal to said first sealing portion;

wherein when assembling said sealing member and said input faceplate, said sealing member is pressed against said input faceplate to cause said malleable sealing metal to deform, thereby hermetically sealing said input faceplate and said side tube.

2. The electron tube according to claim 1, wherein a metal accommodating portion for accommodating said malleable sealing metal interposed between the first sealing portion and the end face of said side tube is formed in the outer surface of said input faceplate.

3. The electron tube according to claim 2, wherein the metal accommodating portion is formed by cutting out a peripheral edge of the outer surface of said input faceplate.

4. The electron tube according to claim 2, wherein the metal accommodating portion includes a step surface parallel to but a step lower than the outer surface of said input faceplate.

5. The electron tube according to claim 2, wherein the first sealing portion is lower than the outer surface of said input faceplate.

6. The electron tube according to claim 1, wherein said support member further includes a third sealing portion extending toward the outer surface of said input faceplate.

7. The electron tube according to claim 6, wherein the third sealing portion contacts the outer surface of said input faceplate.

8. The electron tube according to claim 1, wherein the faceplate accommodating portion is defined by a faceplate supporting surface opposing and contacting the inner surface of said input faceplate, and a side surface opposing the outer peripheral surface of said input faceplate.

9. The electron tube according to claim 1, wherein the faceplate accommodating portion is defined by a faceplate support surface opposing and contacting the inner surface of said input faceplate, and a side surface opposing the outer peripheral surface of said input faceplate, and wherein a first corner line formed at an intersection of the faceplate support surface and the side surface of the faceplate accommodating portion and a second corner line formed at an intersection of the inner surface and the outer peripheral surface of said input faceplate form a close fit with each other.

10. The electron tube according to claim 1, wherein a metal inflow portion for accommodating said malleable sealing metal interposed between the first sealing portion and the end face of said side tube is formed in the first end portion of said side tube, the metal inflow portion being defined by the outer peripheral surface of said input faceplate, and a protruding portion extending to the direction of the imaginary central axis and formed in the end face of said side tube.

11. The electron tube according to claim 10, wherein the protruding portion of the metal accommodating portion has an outer surface substantially in flush with the outer peripheral surface of said side tube.

12. The electron tube according to claim 10, wherein the protruding portion of the metal accommodating portion has an inner surface substantially in parallel to the direction of the imaginary central axis.

13. The electron tube according to claim 10, wherein the protruding portion of the metal accommodating portion has a tapered inner surface such that a cross-section of the metal accommodating portion gradually increases toward the first seal portion.

14. The electron tube according to claim 10, wherein the protruding portion of the meal accommodating portion has a top surface substantially perpendicular to the direction of the imaginary central axis and substantially in flush with the outer surface of said input faceplate.

15. The electron tube according to claim 10, wherein the protruding portion of the meal accommodating portion has a top surface substantially perpendicular to the direction of the imaginary central axis and lower in level than the outer surface of said input faceplate.

16. The electron tube according to claim 10, wherein the outer peripheral surface of said input faceplate is tapered with respect to the imaginary central axis.

17. The electron tube according to claim 1, wherein the first sealing portion is substantially in flush with the outer surface of said input faceplate.

18. The electron tube according to claim 1, further comprising a semiconductor device disposed in the internal vacuum space and attached to said stem.

19. The electron tube according to claim 16, wherein said semiconductor device is an avalanche photodiode.

20. A photomultiplier tube having an internal vacuum space, comprising:

a side tube having an imaginary central axis, an inner peripheral surface, an outer peripheral surface, a first end portion at one end in a direction of the imaginary central axis, and a second end portion opposite the first end portion, the first end portion having an end face;

an input faceplate accommodated and supported by a faceplate accommodating portion formed by pressing said side tube, said input faceplate having an inner surface, an outer surface, and an outer peripheral surface;

a photocathode that emits electrons responsive to incident light applied to said photocathode through said input faceplate;

a dynode stack disposed in the internal vacuum space, and dynode stack multiplying the electrons relayed from said photocathode;

a stem provided to the second end portion of said side tube, said stem, said side tube, and said input faceplate defining the internal vacuum space;

a sealing member formed with a malleable sealing metal and a support member that encircles said malleable sealing metal, said support member including a first sealing portion opposing the outer surface of said input faceplate, and a second sealing portion opposing the outer peripheral surface of said side tube, said second sealing portion being substantially orthogonal to said first sealing portion; and an anode provided to the second end portion, wherein when assembling the photomultiplier tube, said sealing member is pressed against said input faceplate to cause said malleable sealing metal to deform, thereby hermetically sealing said input faceplate and said side tube.

21. The photomultiplier tube according to claim 20, wherein the first end portion of said side tube is bed outward so that the first end portion thereof is separated from the outer peripheral surface of said input faceplate, the first end portion thereof and the outer peripheral surface of said input faceplate forming a metal inflow portion for accommodating said malleable sealing metal.

22. A method of assembling a side tube and a faceplate while using a sealing member formed with a malleable sealing metal and a support member that encircles the malleable sealing metal, the support member including a first sealing portion and a second sealing portion substantially orthogonal to the first sealing portion, the side tube having an outer peripheral surface, and the faceplate having an outer surface, the method comprising the steps of:

(a) fitting said faceplate into a faceplate accommodating portion formed at one end portion of the side tube; and (b) thereafter, pressing the metal support member toward said faceplate such that the malleable sealing metal is placed over a corner portion formed by the faceplate and the side tube, causing the malleable sealing metal to deform, thereby hermetically sealing said faceplate and said side tube.

23. The method according to claim 22, wherein in step (b), the first sealing portion is held to oppose the faceplate, the second sealing portion to oppose the outer peripheral surface of the side tube, and the first sealing portion is pressed toward the outer surface of the faceplate.

24. The method according to claim 22, wherein the sealing member further includes a third sealing portion extending in a direction parallel to the second sealing portion, and the step (b) comprises the step of pressing the metal support member toward the faceplate with the third sealing portion while maintaining the first sealing portion substantially in parallel to the faceplate.

* * * * *